US005996306A

United States Patent [19]

Rionde

[11] Patent Number: 5,996,306

[45] Date of Patent: Dec. 7, 1999

[54] WALL OR CASING MADE OF METAL STRETCHED OVER A FRAME OR STRUCTURE, AND CONSTRUCTION PROCEDURE

[75] Inventor: Guy Rionde, Vittel, France

[73] Assignee: Rionde S.A., Vittel, France

[21] Appl. No.: 08/875,854

[22] PCT Filed: Apr. 16, 1997

[86] PCT No.: PCT/FR97/00684

§ 371 Date: Aug. 6, 1997

§ 102(e) Date: Aug. 6, 1997

[87] PCT Pub. No.: WO97/38921

PCT Pub. Date: Oct. 23, 1997

[30] Foreign Application Priority Data

Apr. 18, 1996 [FR] France ..... 96 05058
Sep. 10, 1996 [FR] France ..... 96 11167

[51] Int. Cl.[6] ..... E04B 2/00; E04G 21/14

[52] U.S. Cl. ..... 52/769; 52/762; 52/745.09

[58] Field of Search ..... 52/762, 769, 773, 52/774, 127.6, 127.11, 127.12, 192, 194, 197

[56] References Cited

U.S. PATENT DOCUMENTS 4,036,390 7/1977 Morse .

FOREIGN PATENT DOCUMENTS

| | | |
|---|---|---|
| 2 658 171 | 8/1991 | France . |
| 2 062 071 | 6/1972 | Germany . |
| 2 235 878 | 1/1974 | Germany . |
| 42 36 304 A1 | 5/1993 | Germany . |
| 292721 | 6/1928 | United Kingdom . |
| 530682 | 12/1940 | United Kingdom . |

*Primary Examiner*—Michael Safavi
*Attorney, Agent, or Firm*—Davis and Bujold

[57] ABSTRACT

A construction of metal walls or closed containers which are used for storage. A wall or shell formed of several sheets of metal (5, 6) juxtaposed at their longitudinal edges (9, 10), resting on longitudinal elements (2, 3) and transverse elements (4). The longitudinal edges of these metal sheets form receptors (13, 14) subject to pressure from transverse movable pushing elements, thereby maintaining one of the edges (9) in abutment with the other (10) and generating lateral, strengthening tension. A method of construction of any individual wall or container by immobilizing sheets of metal (5, 6) along their longitudinal edges (9, 10) on longitudinal elements using opposing transverse force exerted locally and at intervals along the entire length of two adjacent sheets of metal (5, 6).

18 Claims, 11 Drawing Sheets

WALL OR CASING MADE OF METAL STRETCHED OVER A FRAME OR STRUCTURE, AND CONSTRUCTION PROCEDURE

The present invention concerns a method for constructing a wall formed of a succession of juxtaposed forms made of sheets of metal suspended on a skeleton or a framework, as well as the wall and the container or shell thus formed.

BACKGROUND OF THE INVENTION

Silos inside buildings are often made using a skeleton or a framework in the general shape of a silo, with an exterior shell made of sheets of metal.

The covering of the silo constitutes its interior wall per se, which is in direct contact with the material or the products stored inside. In general, the exterior is attached to the skeleton or framework using conventional methods such as screws, rivets, or the like, while keeping the interior surface as smooth as possible. With this type of construction, it is also necessary for the areas with the greatest exposure to shocks or the areas with wide spaces between portions of the framework to have longitudinal and lateral reinforcements such as girders bracing the structure.

These traditional, prior art designs have numerous drawbacks, particularly from the construction perspective, and involve manual labor when constructing a silo, which is increased even further by the addition of lateral or longitudinal reinforcements.

A silo with a suspended exterior shell is known in the art and described in French Patent Publication No. 2 658 171 in the name of the applicant. This silo consists of a succession of metal forms fastened at their upper edges onto the longitudinal frame elements, and attached in overlapping arrangement at their lower portion in much the same way as roofing tiles or shingles are positioned.

This type of silo eliminates a considerable amount of manual labor and offers quite an improvement over traditional silos. In effect, it is necessary merely to position the metal forms, which have pre-shaped upper edges conforming to the elements of the framework. This is a simple, quick job which can be accomplished by a semi-skilled worker. However, certain aspects of this type of silo can be improved.

One such aspect concerns the edges of the sheets of metal, which have irregular transverse ridges. The products inside the silo, which are in direct contact with these discontinuous areas, may become damaged or even stuck to the ridges, depending upon their nature. The irregularities in the interior silo surface may also mark the stored products if they are made of a deformable, flexible material. This problem often arises during storage of products such as plastic bottles, as a fair number of such bottles emerge from storage with unattractive striations or marks resulting from contact and friction with the edges of the sheet metal. This cosmetic flaw is considered serious enough that silos of this type are not used by certain producers who bottle their products in plastic containers.

The second aspect concerns the possible formation of linear openings between two successive sheets of the metal covering the silo, and in general, the development of frequent leaks in such assemblages, allowing air and dust to enter. For this reason, this type of silo is unsuitable for storing bulk products, particularly food products.

SUMMARY OF THE INVENTION

The goal of the present invention is to overcome these disadvantages by proposing a method for constructing a wall attached to a framework or a skeleton, for example, the wall of a silo-type container or, more generally, the shell of any type of container, by juxtaposing successive forms made of sheets of metal.

The invention concerns any wall made of sheets of material, especially stainless steel, plastic, or other such material. Some examples are separating walls, supporting walls, protective walls, and insulating walls, as well as roofs, non-planar, exterior, shingled, reinforcing, or protective surfaces.

In accordance with the present procedure, and according to its principal feature, the longitudinal edges of each sheet of material are shaped into locking receptor elements; the framework is constructed with a rectilinear channel which receives the longitudinal edges of each sheet, and support zones are formed in this channel on either side of it and at longitudinal intervals along the sheets, wherein two opposing longitudinal edges of two adjacent sheets are pushed together and laterally forced against each other, causing lateral tension on the sheets, said pushing elements being retractable between an active, maintenance position and an inactive, inoperative position, in which the edges are no longer joined. If necessary, there can also be a means for providing longitudinal tension.

The present invention also relates to a wall or an exterior shell obtained according to the preceding method and consisting of juxtaposed sheets covering a skeleton or a framework formed of assembled horizontal or vertical elements, characterized in that the longitudinal edges of each sheet are shaped into receiving or blocking structures, and in that the skeleton has rectilinear channels which receive the opposing longitudinal edges of the two adjacent sheets, said receiving channels comprising support zones which laterally contact the two opposing edges using retractable pressure elements, and in that the longitudinal edges are laterally forced against each other by these elements.

If fine sheets of material are used, longitudinal tension means are also provided.

The present invention also concerns a more elaborate or extensive object or product, such as a silo or in general, a container, a shelter, a building, or the like, consisting of a skeleton and a cover.

According to one of its advantages, the instant invention eliminates any transverse edges, particularly edges projecting from the interior silo surface, which exert pressure on the products inside the silo and damage them.

Further specific advantages of the invention are as follows:

- the sheets of material are not punctured or rough;
- the edges and the sheets of covering material are connected in the same plane;
- the complete absence of joints eliminates any possibility of bacteriological contamination;
- in the case of a silo, the structure is sealed and therefore can be used in numerous applications, particularly pressurized silos;
- the seal can be reinforced using single or multiple longitudinal edges with interlocking shapes;
- the permanent lateral tension of the metal, which may be augmented by longitudinal tension when necessary, provides adequate rigidity, and thus thin sheets of metal can be used, eliminating the need for supplemental reinforcing means to be soldered or screwed on.

But the main feature of the invention consists of reduced labor costs for building a wall, a shell, or a unit formed on a base of walls such as a silo (although it is not limited to a silo), because it can be constructed quickly by semi-skilled workers.

The constructed units are also airtight because they do not require the sheets of covering material to be overlapped.

BRIEF DESCRIPTION OF THE DRAWINGS

Other characteristics and advantages of the invention will be apparent from the following description, given by way of example, and from the accompanying drawings, wherein.

DESCRIPTION OF THE PREFERRED EMBODIMENT(S)

In general, the present invention applies to a silo formed of juxtaposed sheets of metal immobilized on a skeleton or an exterior framework and to the method of constructing the silo. For a better understanding of the invention, the first description concerns the formation of a wall with a smooth interior surface on an exterior skeleton, with sheets of juxtaposed metal attached to the skeleton, immobilized by gripping means at various locations along their edges, using lateral tension supplemented by longitudinal tension when needed.

The description will begin with an incomplete base or elementary wall. Obviously, the elementary wall is duplicated laterally to form the lateral surface of the silo and its covering.

A skeleton which will become the frame 1 of the silo or other closed storage unit is constructed using girders such as elements 2 and 3 and vertical elements or posts such as frame posts 4 connected to each other by soldering or assembled by other mechanical means.

These assembled elements are the supporting unit for the adjacent juxtaposed sheets of metal 5, 6, which are generally quite long.

Figure 1:
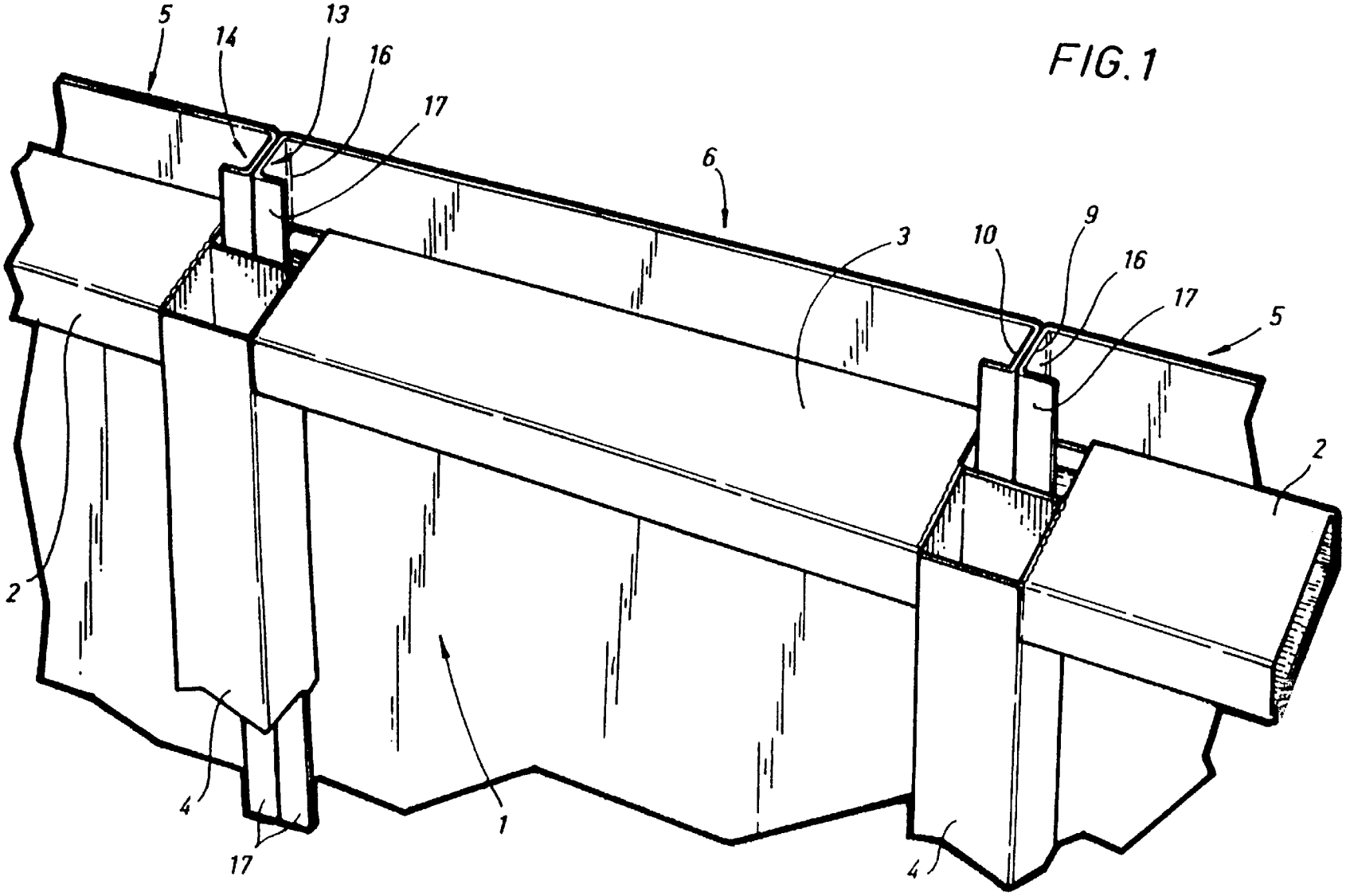
FIG. 1 is a perspective of a portion of the lateral surface wall of the silo.
Figure 2:
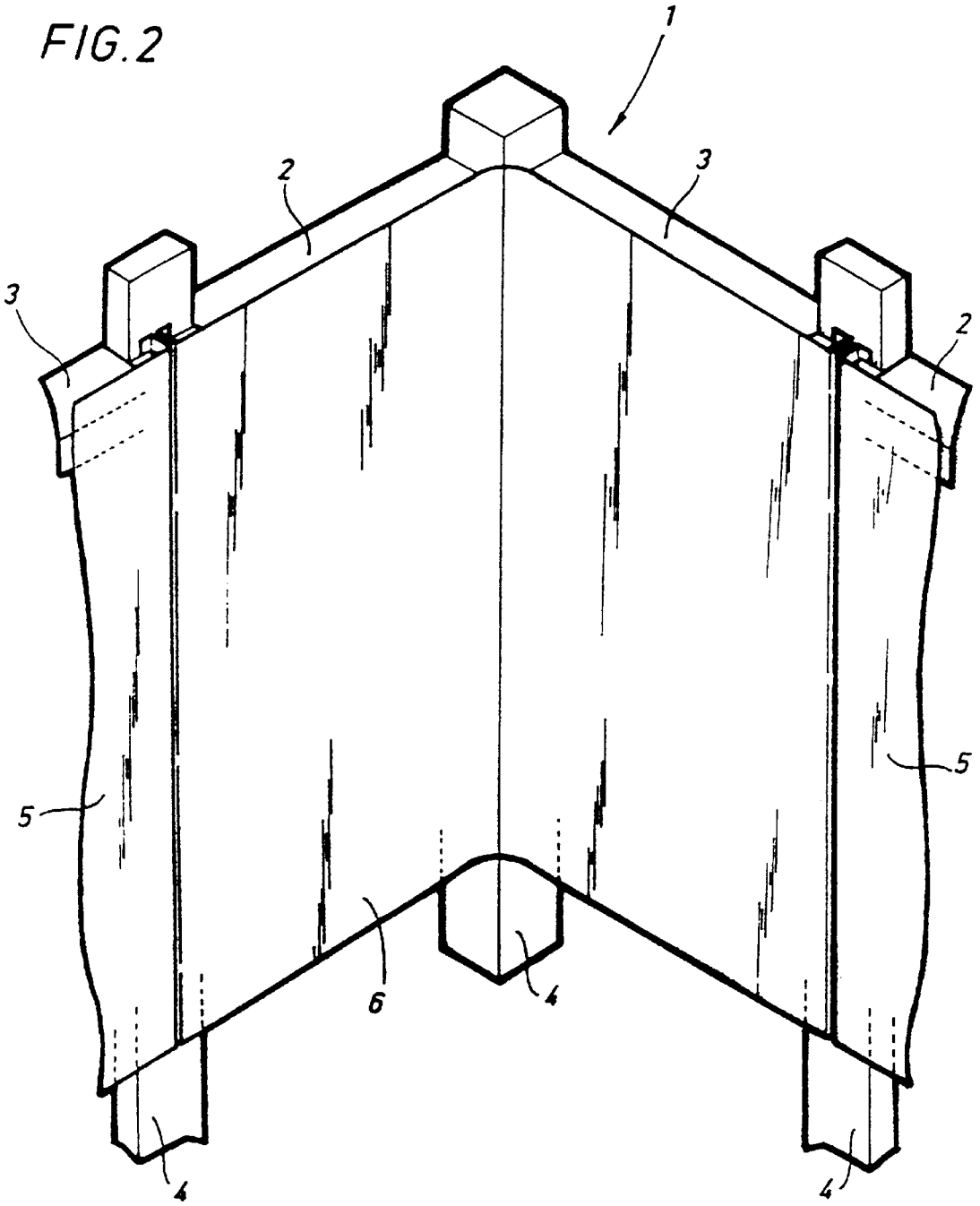
FIG. 2 is a perspective of an example of an angled zone.
Figure 4:
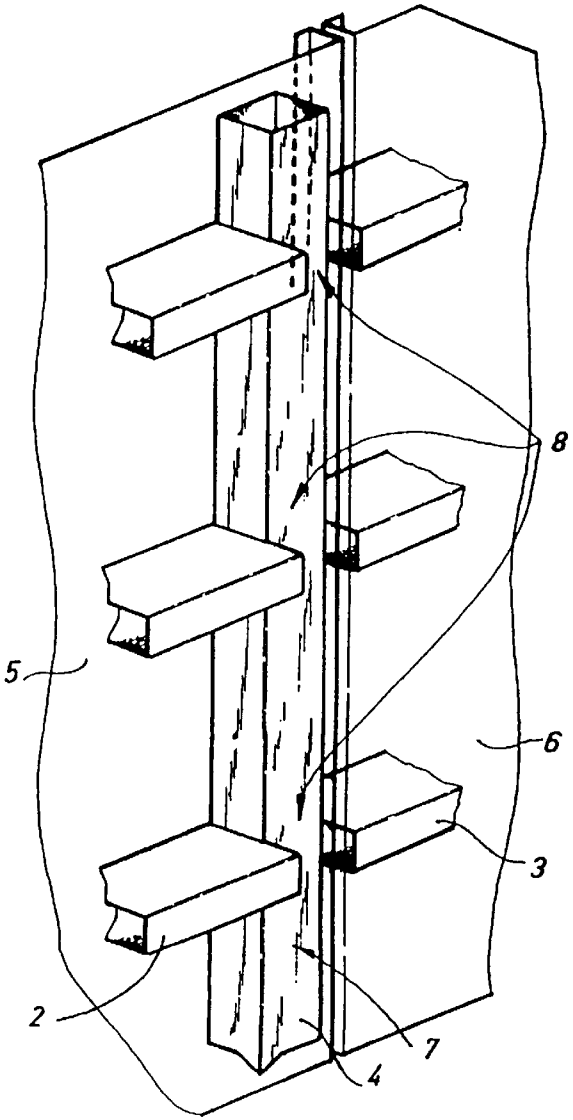
FIG. 4 is a perspective of the front of one portion of a skeleton element showing the rectilinear receptor channel which accommodates the longitudinal edges of two juxtaposed sheets of metal.
Figure 3:
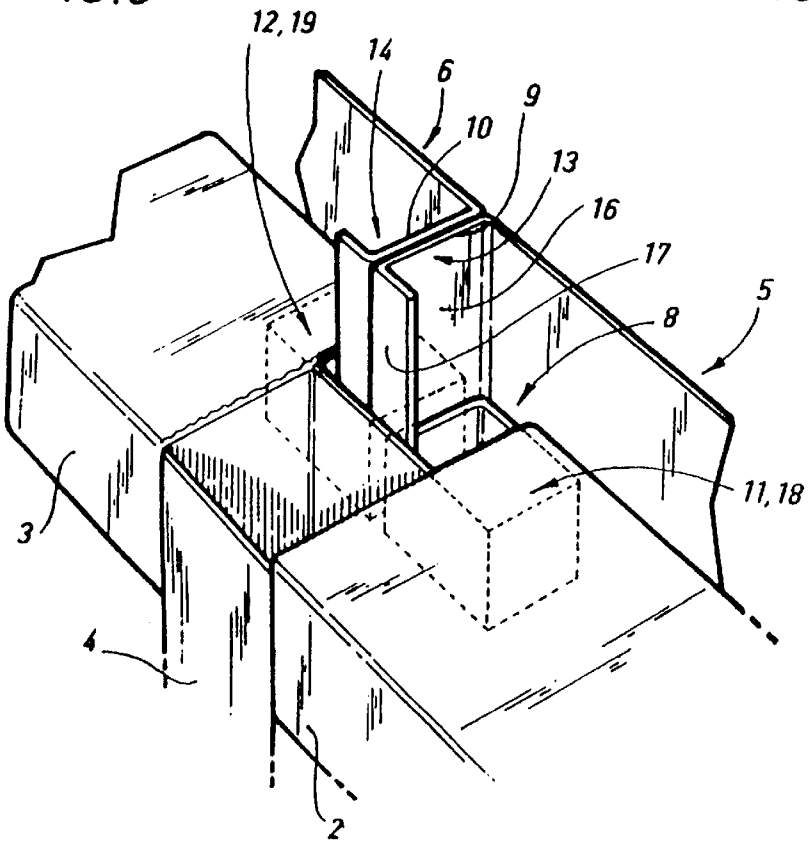
FIG. 3 is. a perspective of a maintenance zone showing the rear of the two opposing pressure elements.
Figure 7:
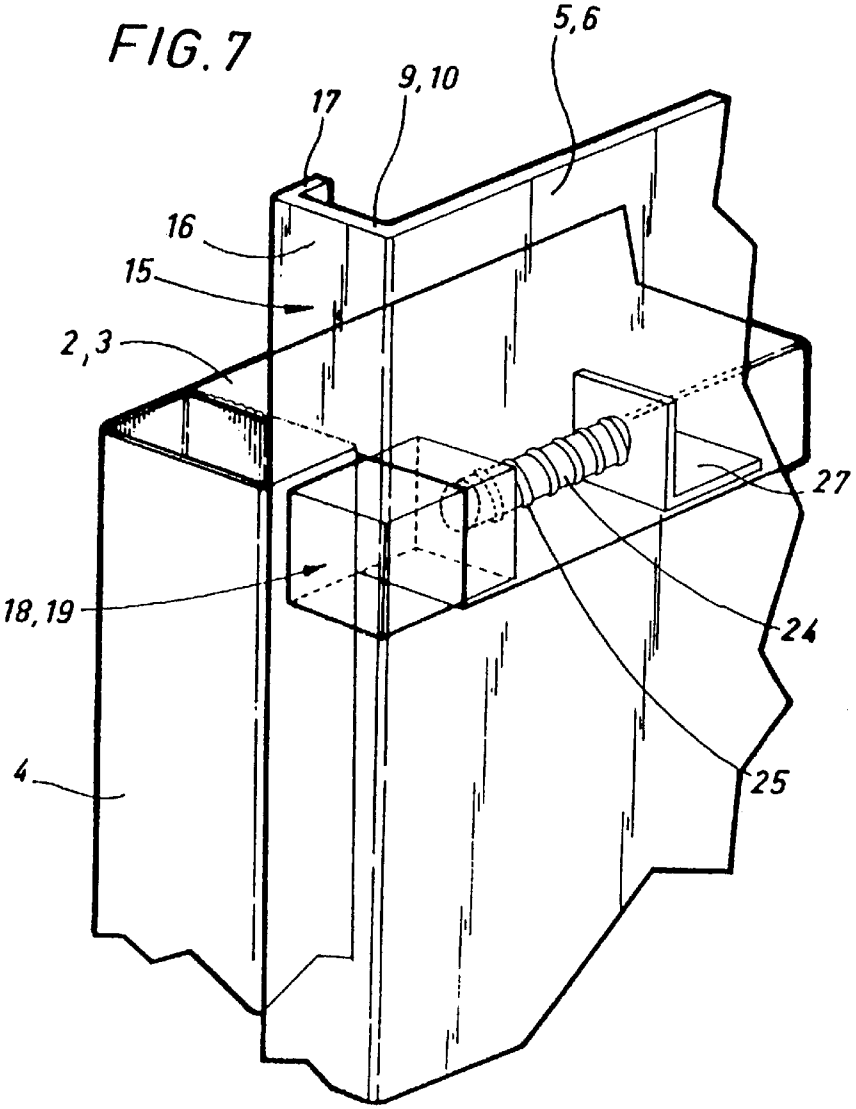
FIG. 7 is a detailed view of a pressure element attached to the support zone with the metal sheet in place.
Figure 5:
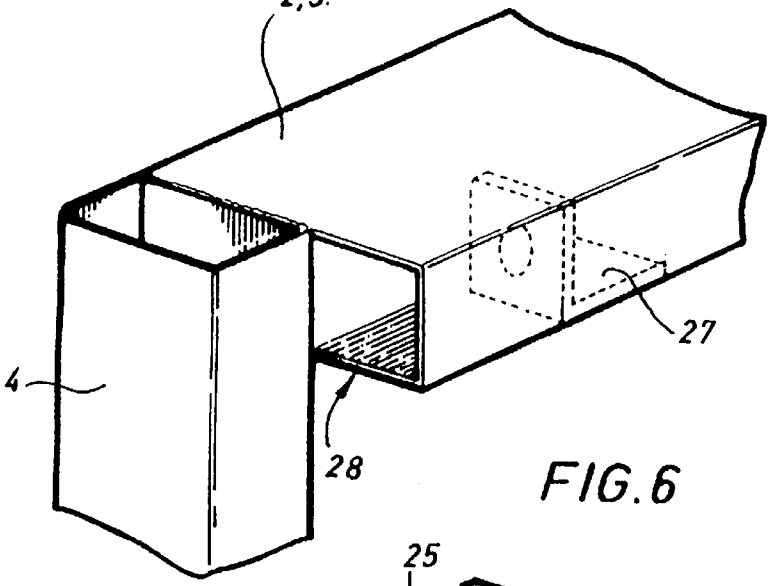
FIG. 5 is a detailed perspective of the junction of three elements forming a receptor zone.
Figure 6:
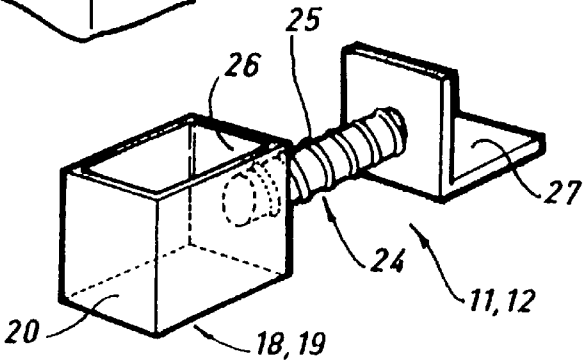
FIG. 6 is a detailed perspective of a grip/support lock.

At horizontal intervals determined by the thickness of the metal, there are vertical, rectilinear receptor channels in the skeleton, such as channel 7 (FIG. 4) and within the channels, at vertical intervals, depending upon the degree of rigidity desired, there are transverse support zones such as zone 8 supporting two sheets of metal 5, 6. Within these zones on the skeleton, two adjacent sheets of metal 5, 6 with homologous longitudinal edges 9, 10 are applied against each other along said opposing longitudinal edges and held in this position, one edge being maintained against the other by the opposing forces originating from movable, transverse opposing elements 11, 12.

To accomplish this, opposing longitudinal edges 9 and 10 on the two adjacent sheets of metal form homologous receptors 13, 14 which are juxtaposed, and which are immobilized and blocked by pressure elements 11 and 12 exerting a counter-force.

Longitudinal edges 9, 10 may be shaped in various ways, as will be seen in detail below. In the preferred embodiment of the invention, receptors 13 and 14 form longitudinal wings such as wings 15, each having a contact surface 16 obtained by bending the edge of the sheet at a right angle and then forming a blocking return 17, also bent at a right angle, but perpendicular to the contact surface.

The appropriately shaped longitudinal edges cooperate in each transverse support zone 8 with the opposing elements 11 and 12, which, according to the preferred variation, are constructed in the form of retractable immobilizing elements and which are attached near receptor 13 or 14 surrounding their front extremities.

At the level of each transverse support zone 8 there are two longitudinal edges 9 and 10 which can be joined to two movable elements 18 and 19 holding pressure elements 11 and 12, which are attached elastically so as to exert pressure on one another.

More specifically, these support zones 8 are provided within and along each vertical receptor channel, the base of which is defined by a vertical element 4. Said channel 7 forms a housing for the two opposing longitudinal edges 9 and 10 on two adjacent sheets 5 and 6. Transverse support zones 8 are provided at vertical intervals and each have two pressure elements 11 or 12 in the form of two locking elements located opposite each other, with movable elements 18 and 19 acting as removable locks exerting counter forces upon the contact surfaces 16 of the two adjacent longitudinal edges and thus forming a minimal relative seal.

Figure 10:
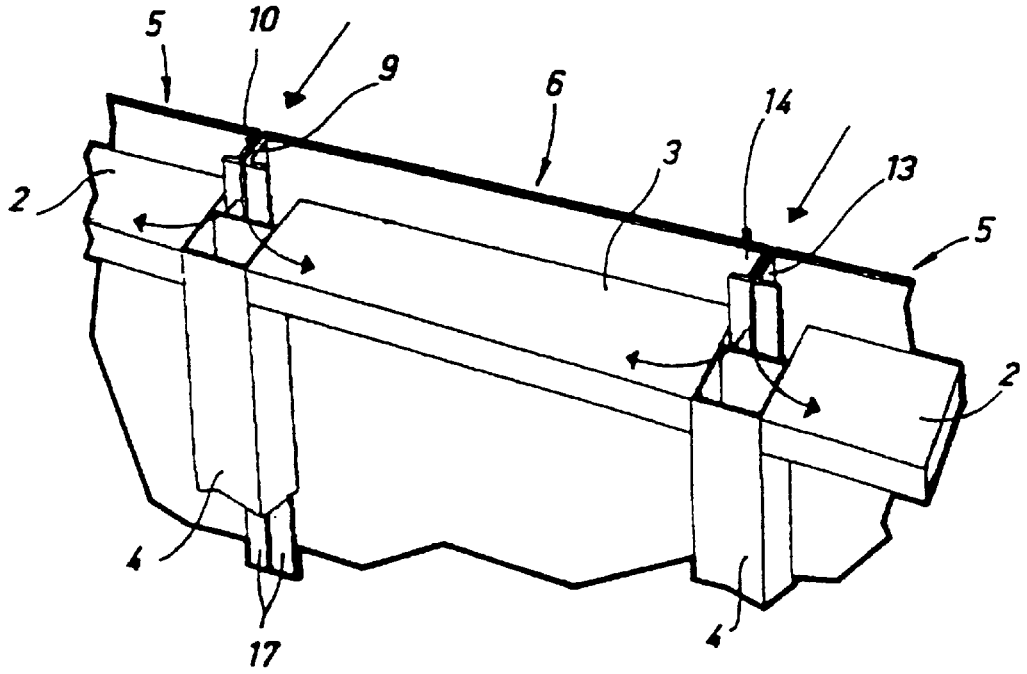

The arrows in FIG. 10 show how air passes between the connecting edges through an air outlet which would be necessary, for example, in the case of a pressurized silo.

Figure 15:
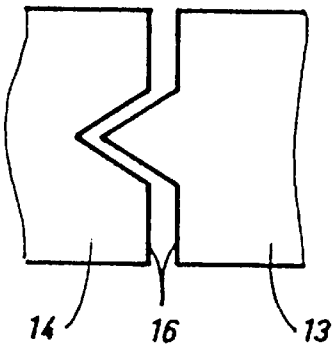
FIGS. 14 through 17 are schematic illustrations of the various receptor elements on the longitudinal edges of the metal sheets.
Figure 14:
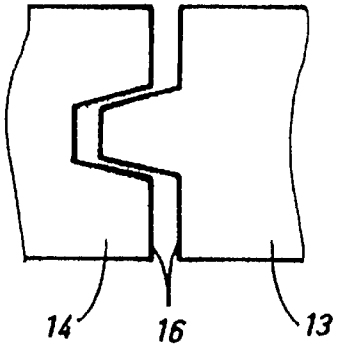
Figure 17:
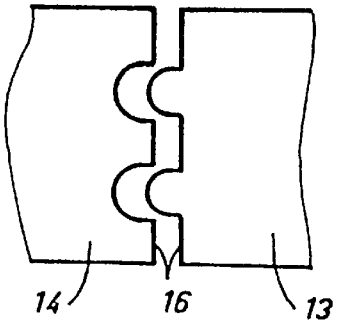
Figure 16:
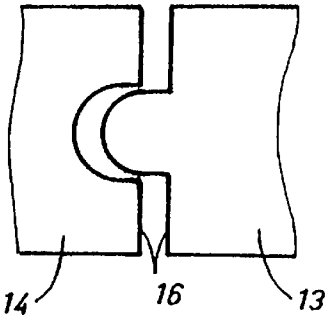

This relative seal can be improved by forming contact surfaces 16 into complementary shapes, either by die-stamping or some other hot or cold metal shaping technique. The complementary forms may be U-shaped (FIG. 14), V-shaped (FIG. 15), single or double C-shaped (FIG. 17), or whatever other single, double, or multiple combination of these shapes is appropriate.

In the embodiment shown, the movable support elements 18, 19 each function as locks but do not block movement.

Figure 11:
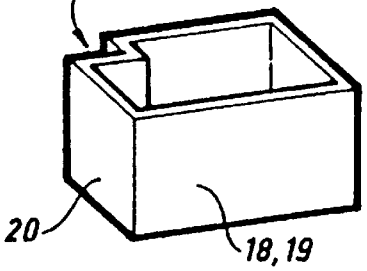
FIGS. 11 through 13 are schematic illustrations of the various possible forms of movable fasteners.
Figure 12:
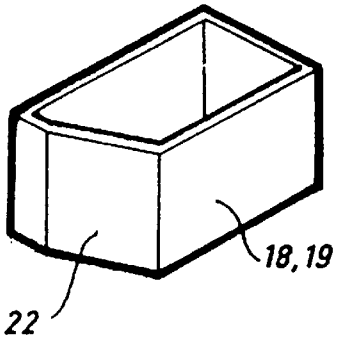
Figure 13:
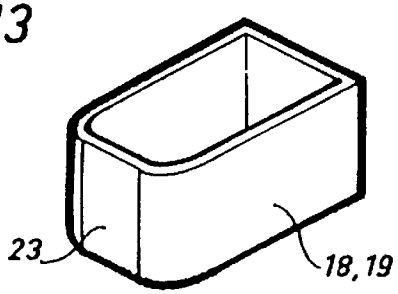

Each lock consisting of movable element 18 or 19 is, for example, generally parallelepiped in shape with a front portion 20 of various shapes, for example, straight and flat, with or without a connector 21, or bisected, or with a central flat portion 23, or some other suitable shape, as shown in FIGS. 11 through 13. The rear surface of these pressure elements extends into a tail 24 in the shape of a rod with a helicoidal spring 25 blocked on one side by the rear surface 26 of the lock and on the other side by a support bracket 27 attached to the adjacent skeleton girder 2 or 3. Supporting bracket 27 has a passageway for rod 24, which extends through the passageway and even beyond it. The path of the spring is preferably blocked by a lateral stop (not shown) when the spring is extended.

In accordance with the variation shown, each lock is translationally guided by three successive adjacent walls of adjacent skeleton girder 2, 3, which, along with the adjacent vertical element, define an outlet opening 28 for the lock.

Naturally, a person skilled in the art might conceive other designs for the pressure elements, the lock, its housing, passageway 28, or the support zones.

Figure 8:
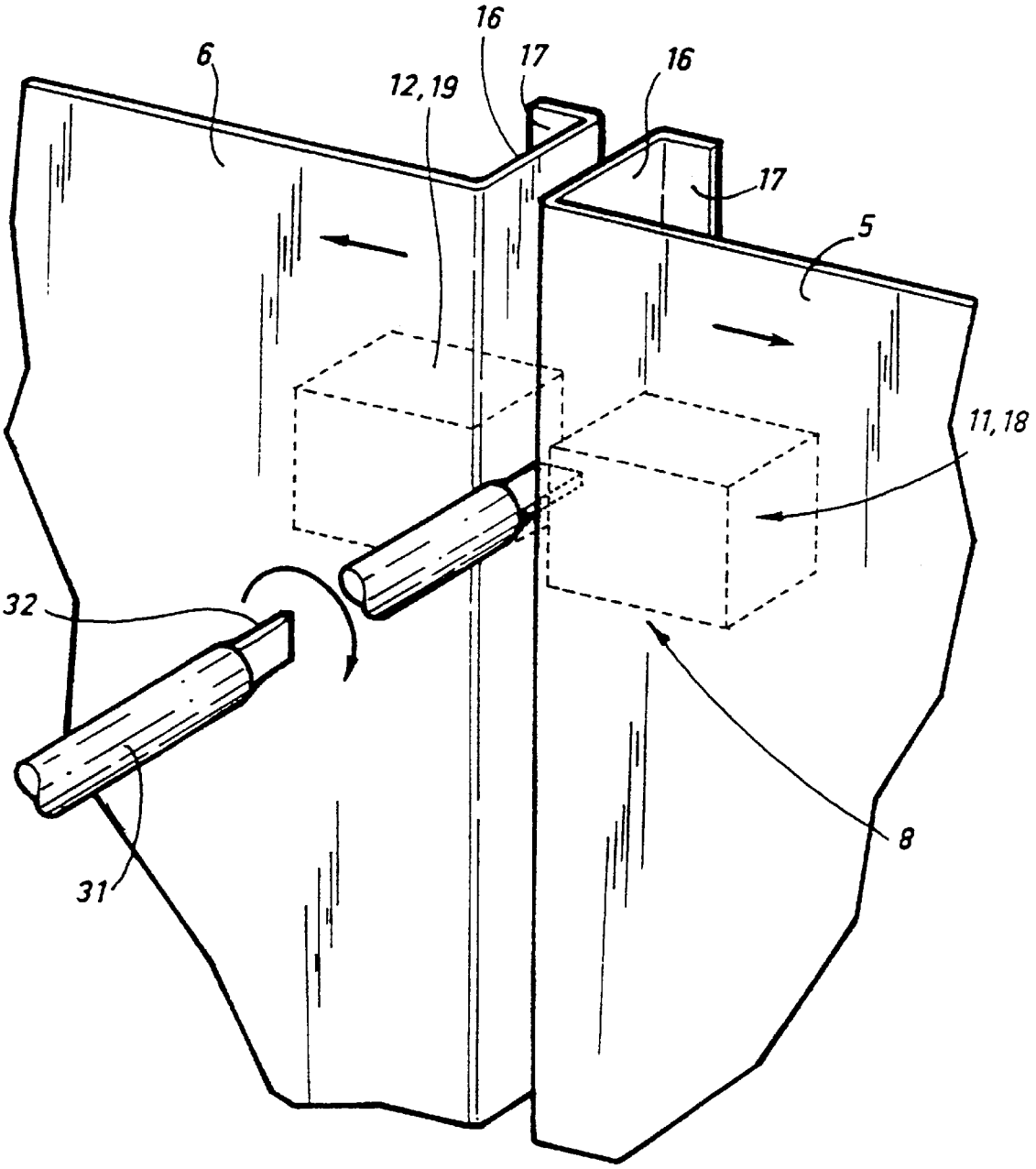
FIG. 8 is a perspective showing the two edges being separated with a tool.
Figure 9:
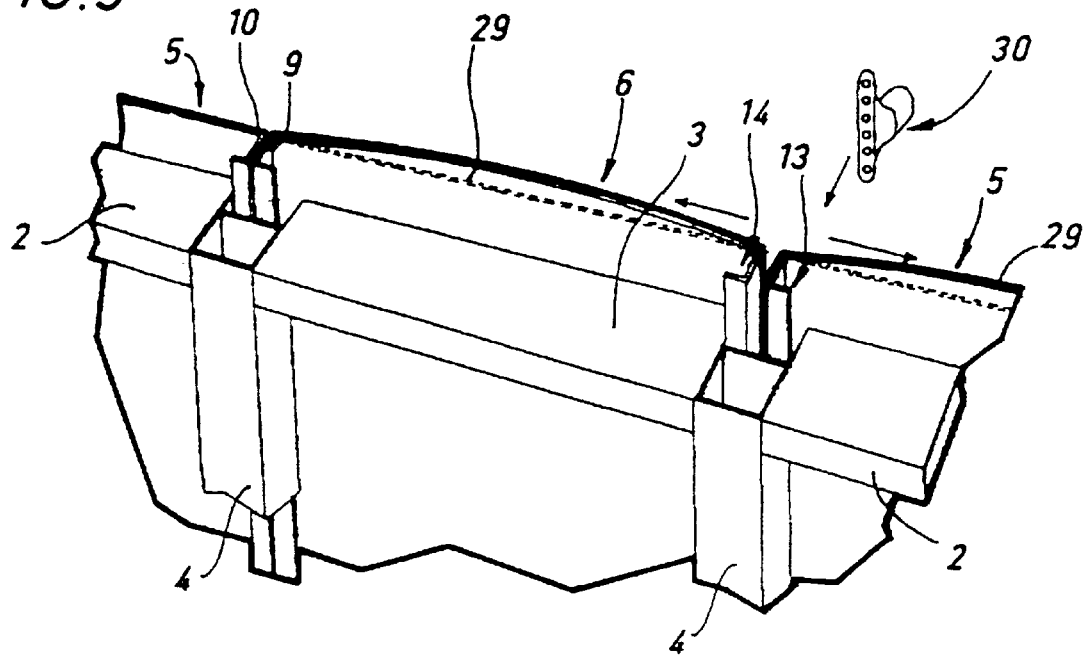
FIGS. 9 and 10 are schematic illustrations respectively showing the cleaning process, using a tube to inject hot water or steam, and the linear openings in the edges forming air outlets in the case of a pressurized silo.

The arrows and dashed lines in FIG. 9 are schematic representations of the slight convex shape 29 of the metal sheets when they are not laterally extended, that is, when adjacent longitudinal edges 9 and 10 are not connected. This drawing also shows how it is possible to interject a cleaning tube 30 between the two edges, previously separated with a tool 31, for example, a flat edged tool 32 (FIG. 8).

The procedure for attaching a wall or the like consists first of forming and shaping the longitudinal edges on sheets of metal 5, 6 which are equal in length to the finished height of the final object, and then constructing the skeleton or framework 1 from girders 2, 3 and vertical elements 4, forming support zones 8 at longitudinal and transverse intervals along receptor channels 7 to accommodate longitudinal edges 9, 10 of the metal sheets; the opposing metal sheet edges are forced against one another by counteracting forces directed toward the contact plane of the corresponding edge and directed towards each other by pressure elements 11, 12.

According to the preferred embodiment, these forces act as elastic recall forces when abutting longitudinal edges 9, 10 of each metal sheet 5, 6 and forcing them against each other.

More specifically, longitudinal edges 9, 10 of the metal sheet are shaped by forming a right angle into a contact surface 16 and also forming a blocking return 17 by bending it into a right angled. This receptor unit is attached to each movable element 18, 19 of pressure elements 11, 12; then the adjacent receptor piece is attached in the same way to the opposing movable piece. These opposing elastic forces push the movable pieces against each other at the rear by contacting the adjacent edges of metal sheets 5, 6.

Each sheet of metal is maintained in transverse position by elements holding one edge 9 to the other 10, placed at regular or irregular intervals along the edges, but sufficiently close together to produce enough lateral tension for the lateral support and rigidity needed.

If needed, there can be specific elements (not shown) providing longitudinal tension which, when associated with lateral tension, provide the rigidity necessary for using thin sheets of metal.

This technique makes it possible to use thin metal sheets because the lateral tension caused by pressure in the support zones provides enough rigidity for supporting a silo or resisting other stress on the wall during normal use.

It is also important to note that the edges of the metal sheets can be dismantled or removed with the same extraordinary ease and speed as they are attached. It is necessary merely to insert an instrument such as a tool 31 with a flat edge 32, a flat rod, or the end of a screwdriver, through the narrow slot between two successive sheets 5, 6; after a quarter rotation, the connecting edges will separate enough to admit the tip of a nozzle or of a suction or diffusion element 30 on a cleaning and/or disinfecting tool.

The method of the invention offers a structure which can be assembled or disassembled with exceptional speed by a semi-skilled individual. The total hourly labor costs for assembling a wall or the like are therefore greatly reduced in proportion to the time required for the operation.

Figure 18:
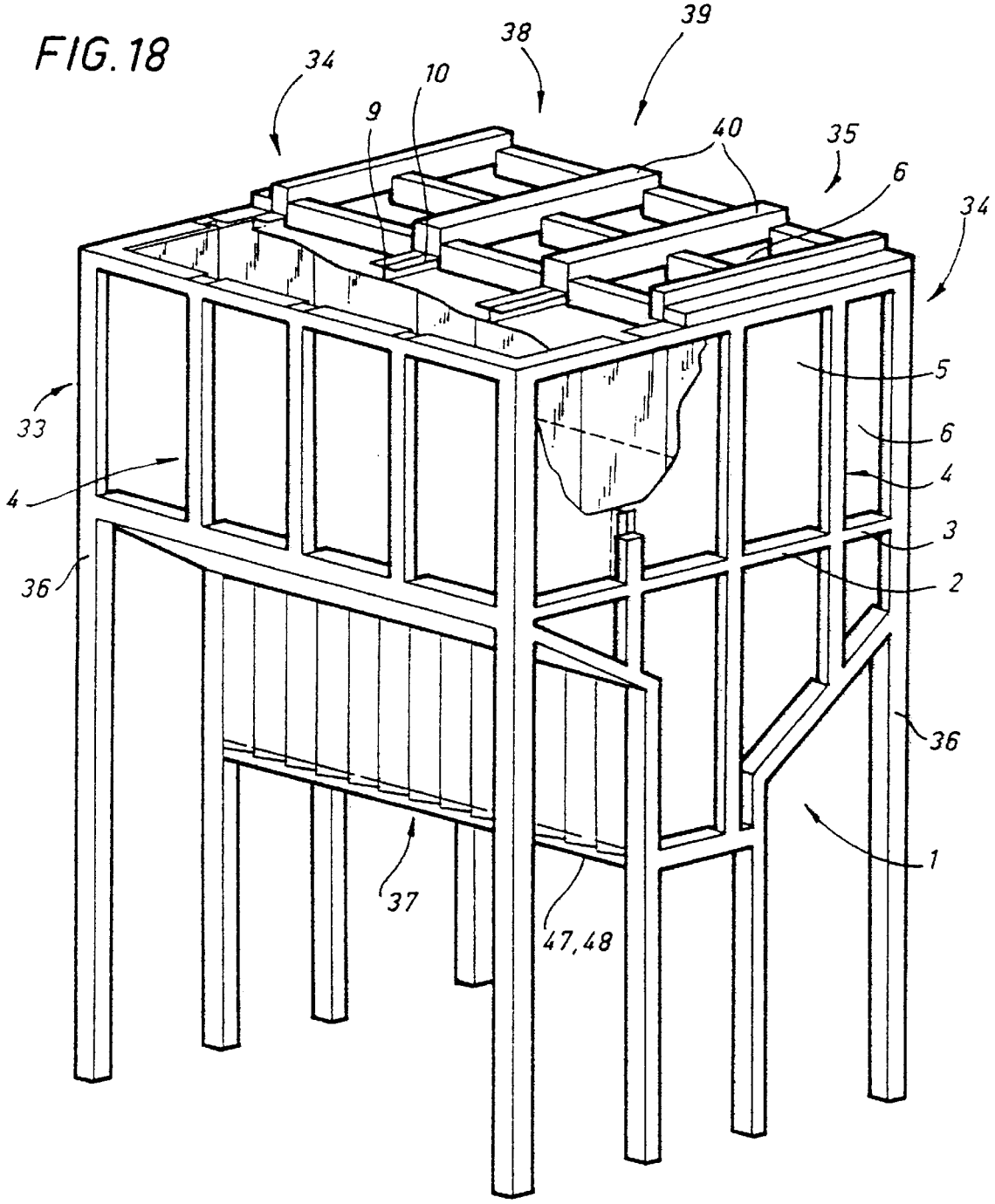
FIG. 18 is a general perspective view of one exemplary embodiment of a silo showing its general form and, in cross-section, an interior portion of the silo.
Figure 19:
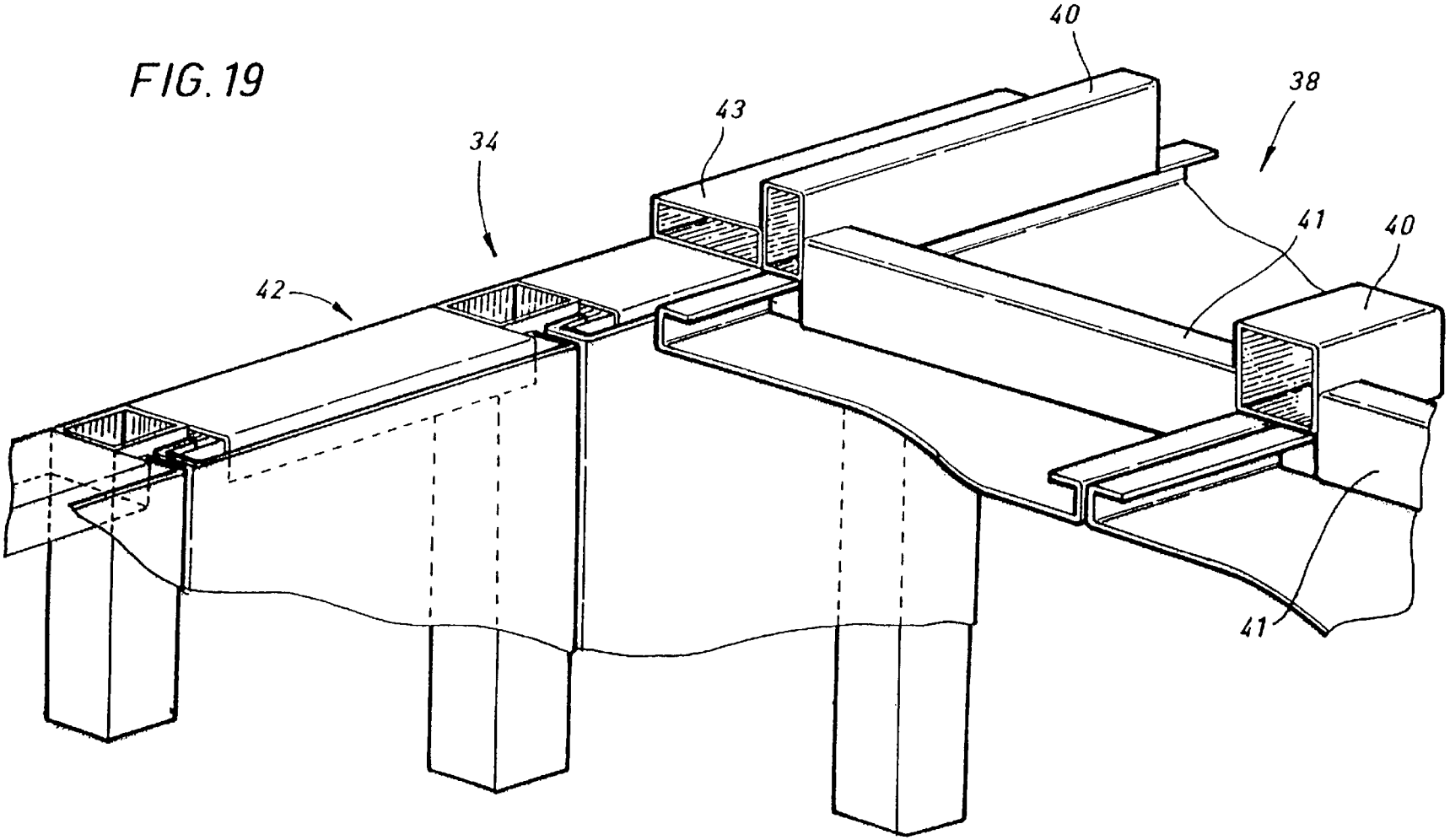
FIG. 19 is a perspective of one exemplary embodiment of the upper silo portion showing a fraction of its lateral surface.
Figure 20:
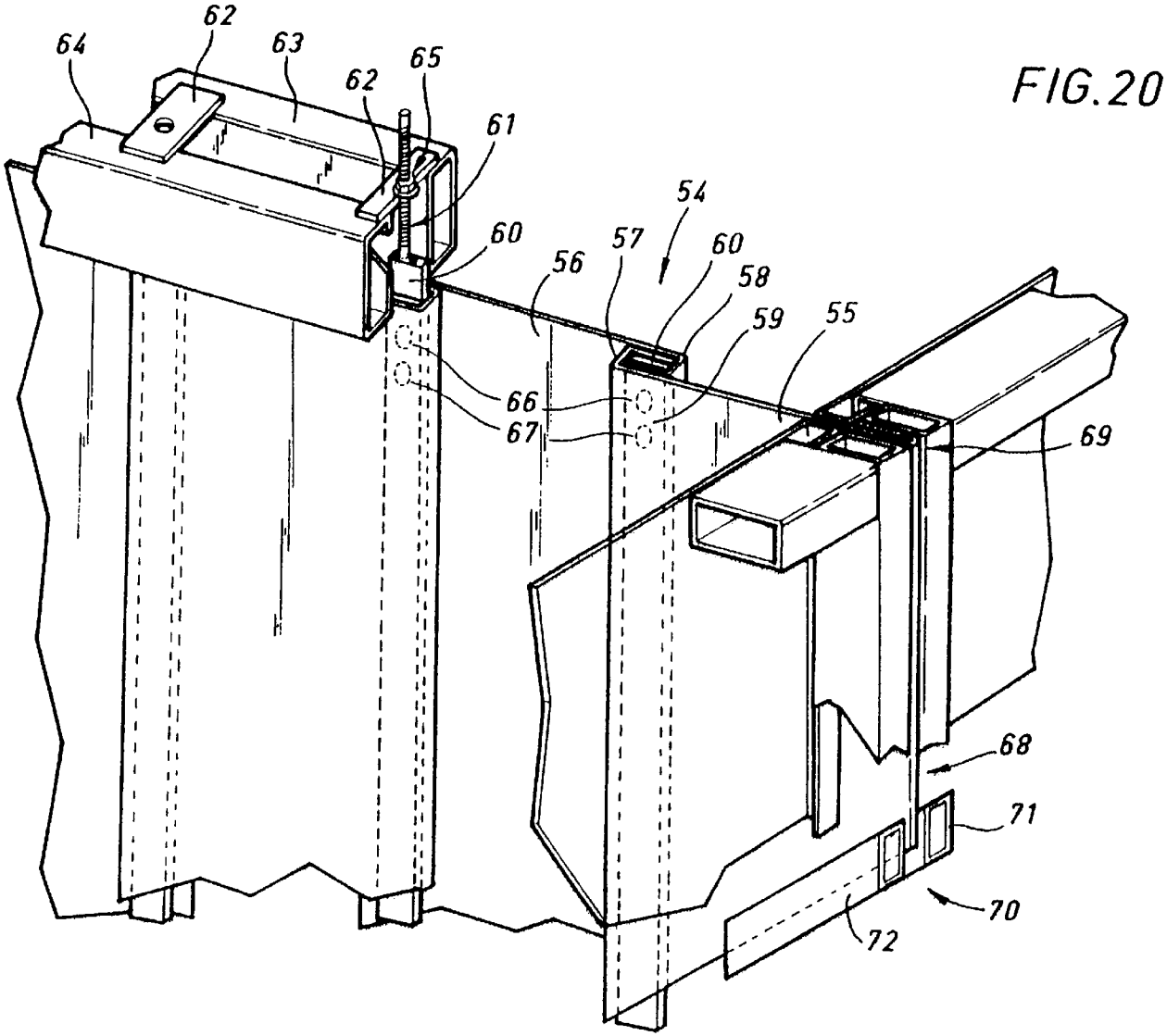
FIG. 20 is a perspective showing an intermediate transverse separating wall and its connection to the adjacent lateral wall.

The following description concerns a silo type container used in one application of the invention, with reference to FIGS. 18, 19, and 20.

As the drawings show, the silo has one lateral surface 33 consisting of longitudinal walls 34 and transverse walls 35, each formed of a lateral succession of juxtaposed sheets of metal, with edges shaped according to the method described above.

The walls are juxtaposed and assembled on the skeleton or framework poles by locking and immobilizing them, as well as forcing one edge against another with pressure elements 11 and 12 forming two opposing locks.

The metal sheets are joined to each other at their corners using angled posts such as element 36.

This construction method is used not only for the walls forming lateral surface 33, but also for base 37 and upper cover structure 38, which will now be described.

Upper cover structure 38 is shown in detail in FIG. 19.

It consists of a network 39 of upper girders 40 and upper crossbars 41 forming a horizontal armature; on the subsurface there are attached the juxtaposed metal sheets with shaped longitudinal edges held by the lock provided for the walls of the lateral surface. This network 39 is connected to the upper portion of the lateral surface walls 34 and 35 in the following manner. The upper girder 40 of each lateral surface wall 42 is formed of a succession of upper surfaces of horizontal elements and the extremities of the skeleton posts, defining between them receptor channels 7. The upper girders 42 of the longitudinal lateral surface walls 34 are closed by a flat tubular element 43 also forming a mechanical retaining edge. This element 43 is integral with upper girder 40 adjacent to the upper covering structure 38 appearing in FIGS. 18 and 19.

Figure 21:
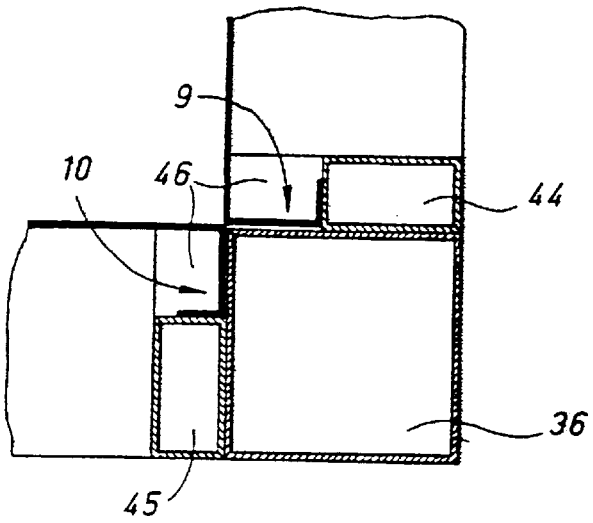
FIGS. 21 through 23 are transverse cross-sections first, of the connection between the wall and the lateral surface; and second, between a horizontal base and an adjacent wall, respectively; and last, between an inclined base and an adjacent wall.

The connection at the crests of the two consecutive lateral surface walls, as shown in FIG. 21, is formed around an angled pole 36 flanked on each of its interior lateral surfaces by vertical tubular contact elements 44 and 45, which are shorter than the sides of angled pole 36, so each one forms a space 46 adapted to hold longitudinal edge 9 or 10 of each metal sheet on the end of the lateral walls. This structure is symmetrical with angled pole 36.

Figure 22:
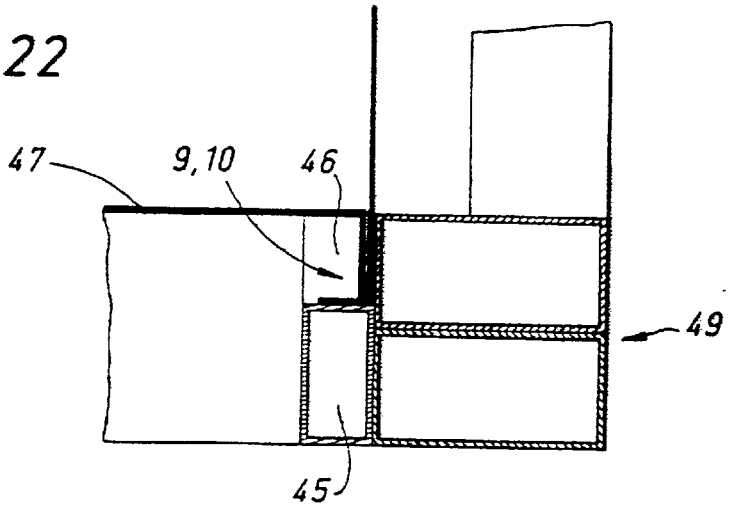
Figure 23:
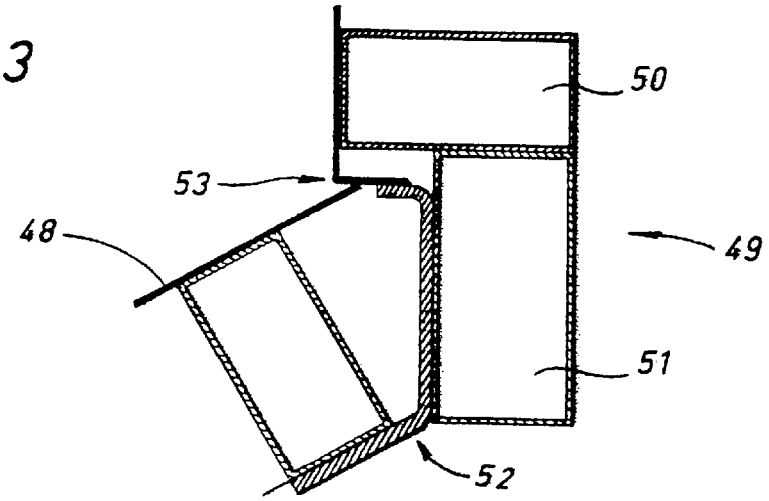

Silo base 37 has a horizontal wall 47 or an inclined wall 48. These walls are connected in a different way, depending upon whether they involve a horizontal base (FIG. 22) or an inclined base (FIG. 23).

If the base has a horizontal wall 47, the connection between base 37 with an element of lower edge 49 is identical to the connection holding angled pole 36 to the lower edge of the adjacent vertical sheet by longitudinal edge 9, 10 of the base sheet on the edge element.

A tubular element 45 forms a space 46 as with the connection on angled pole 36.

With an inclined base 48, the connection is more complex. The lower edge 49 is formed of two elements 50 and 51 forming an upside down "L". Wall 48 of the inclined base diagonally abuts vertical element 51 of lower edge 49 using an annexed, wide angle end support 52 integral with peripheral element 49 of the base wall. The metal sheets of the adjacent lateral wall and inclined base wall 48 are sealed at their extremities. For example, note that on the sheet of the lateral wall, one extremity 53 forms a right angle, while the sheet of the base wall has a projecting overhang.

The descriptions above concern a conventional silo type container, with a base that is either horizontal or inclined. However, various other shapes and other types of containers are possible using the same construction and design techniques.

In addition, but only when necessary, the invention provides an supplemental means of applying longitudinal tension to the metal sheets. This is a specific requirement when using thinner sheets of metal.

Permanent longitudinal tension can be achieved in various embodiments of the invention.

This tension or rigidity is present in the case of the separating wall 54 of the silo shown in FIG. 20. Separating wall 54 is formed of a lateral succession of several metal sheets 55, 56 with their longitudinal edges 57, 58 folded and overlapping each other so as to form a longitudinal, vertical, flat housing 59 for a core or a metal layer 60 in the form of a flat metal piece acting as a reinforcement or strengthening element.

Each reinforcement 60 exerts tension on the metal sheet using a tractive element. This may consist of threaded rods 61 each passing through a connecting support 62 which connects, at intervals, both beams 63 and 64 of a transverse girder located above the transverse separating compartment 54. The lower extremity of each threaded rod is connected to the upper extremity of each reinforcement 60. On the body of the threaded rod there is a screw-washer unit 65 contacting the upper transverse supporting surface of connection 62 traversed by threaded rod 61, thereby exerting vertical pressure which can be adjusted by positioning the screw.

This tension is transmitted to the adjacent metal sheet, since each reinforcement 60 is immobilized against the sheet by two bolts or screws 66, 67 with pointed ends.

This tension means associated with each reinforcement 60 is described with reference to separating wall 54. It can, of course, be used also with longitudinal walls 34 and transverse walls 35 on the lateral surface of the silo.

Separating compartment 54 is connected to the lateral surface in the following manner.

The longitudinal edges of the end sheets of metal are folded and maintained at the level of a connecting assemblage 68 on the lateral surface. The double thickness of the folded edge 69 of the vertical edge of sheet 55 rests between two opposing skeleton posts 4. The end sheet of metal 55 of separating wall 54 passes between the two opposing longitudinal edges 9 and 10 of two nearby sheets of metal on the lateral surface and is gripped and immobilized between these edges by the counteracting forces of the pressure elements. This effect is augmented by the presence of a lower oblique edge 70 formed of two parallel tubular elements 71 and 72 which hold the metal between them with tightening elements, such as bolts (not shown).

The method of forming and constructing a silo according to the invention consists first, of constructing an exterior skeleton or frame 1 using horizontal girders 2, 3 and posts 4, maintaining separations between the extremities of the horizontal elements to create receptor channels 7 to receive longitudinal edges 9, 10 of the metal sheets, and second, of positioning the locks of pressure elements 11 and 12 and placing the metal sheets on the structure. The length of the sheets is at least equal to the height of the lateral surface walls.

Next, the connections at the angled posts 36 and the lower connections between the lateral surface walls and the base wall are made.

If an upper covering structure is desired, the upper peripheral edge is then positioned using a flat tubular element above upper beam 42 of longitudinal lateral walls 34. Next, the upper covering structure is constructed in the same manner as the lateral surface walls, and the sheets of metal are positioned and immobilized using the restraining locks.

If needed, a separating compartment 54 is attached, using no vertical posts, but using reinforcements 60 connected to an upper girder 63, 64 by an element exerting tension on the metal sheets.

Insofar as the metal sheets are concerned, their longitudinal edges 9, 10 are shaped into a right angle forming a contact surface 16 with an angled, blocking return 17. This receptor form is attached to each movable piece 18, 19 of the locks, and then the adjacent receptor form is attached in the same way to the opposite movable piece. The opposing elastic forces push the movable pieces against each other by rear contact with the adjacent edges of metal sheets 5, 6.

Each sheet of metal is transversely maintained by elements fastening one edge 9 to the other edge 10 spaced at regular or irregular intervals along its length, but close enough together to produce enough lateral tension for the desired support and rigidity.

As indicated, if necessary, specific means can be provided to produce longitudinal tension, one example being the separating compartment referred to above, and these elements, in association with lateral tension, provide additional rigidity when using thin sheets of metal.

This technique makes it possible to use thin sheets of metal because the lateral tension supplied by the locks in the support zone imparts sufficient rigidity to support the silo contents.

It should be noted that not only are the locks quickly and easily placed on the skeleton or framework elements provided for that purpose, but the metal sheets are just as easily positioned. Therefore, it is quick and easy to disassemble or move the structure. To separate or disengage the edges of the metal sheets, one need only insert an instrument or a tool 31 with a flat end, or a flat rod, a screwdriver tip, or other suitable instrument through the narrow slot between two successive sheets of metal 5, 6, rotating the instrument a quarter turn to separate the connecting edges enough to admit a spray, aspiration or diffusion tip or nozzle 30 for cleaning and/or disinfecting the structure.

The invention features an exceptionally rapid method of silo assembly/disassembly that can be accomplished using semi-skilled labor. Thus, the total labor costs for constructing the unit are greatly reduced in proportion to the hours required and the skill of workers employed.

Finally, the only technical assistance needed to construct such a unit is a detailed set of instructions.

I claim:

1. A wall being formed from a plurality of juxtaposed sheets of metal being suspended from a framework, each of said plurality of juxtaposed sheets of metal (5, 6) having two opposing longitudinal edges (9, 10) being formed into receptor structures (13, 14); and said framework (1) being formed from an assemblage of vertical supports (4) having rectilinear channels for receiving said longitudinal edges (9, 10) of two of said plurality of juxtaposed sheets of metal (5, 6), and said framework having a plurality of transverse support zones (8), at spaced intervals along each of said vertical supports, for securing two of said plurality of juxtaposed sheets of metal to said framework, each said support zone (8) supporting a mating pair of opposed transverse separately retractable counteractive pressure elements (11, 12) for sandwiching and securing the receptor structures (13, 14) of two of said plurality of juxtaposed sheets of metal therebetween with adjacent surfaces of said receptor structures (13, 14) directly contacting one another.

2. The wall according to claim 1, wherein said separately retractable counteractive pressure elements (11, 12) each have an elastic recall means constantly biasing each said pressure element into an active operative position and facilitating retraction of said pressure elements into a retracted, inoperative position.

3. The wall according to claim 1, wherein each of said longitudinal edges (9, 10) is shaped like a wing (15) and has a contact surface (16) which is bent at a right angle and a blocking return (17) that is formed at a right angle.

4. The wall according to claim 3, wherein complementary concave areas and raised areas, respectively, forming mutually interlocking surfaces, are formed on each corresponding opposed wing (15) of said juxtaposed sheets of metal.

5. The wall according to claim 2, wherein each of said pressure elements (11, 12) has a movable element (18) which is generally parallelpiped, and each said moveable element is slidably and elastically biased by a spring such that a first end of said spring abuts against a bracket (27) and a second opposed end of said spring abuts against said movable element.

6. The wall according to claim 5, wherein said framework is further formed by a plurality of transverse girders (2, 3), and each of said girders has three adjacent surfaces forming a cavity which houses said bracket of said movable element and said three adjacent surfaces guide said movable element to and from its active operative position and its retracted inoperative position.

7. The wall according to claim 6, wherein said movable element (18) has at least one planar surface on a front portion (20) thereof for engaging with an adjacent surface of one of said receptor structures (13, 14).

8. The wall according to claim 1, wherein said framework further includes means for applying vertical tension to said plurality of juxtaposed sheets of metal (5, 6).

9. A method for attaching and immobilizing a plurality of sheets of metal (5, 6) to a framework (1) to form a desired structure with an exterior wall, said method comprising the steps of:

bending a pair of opposed longitudinal edges (9, 10) of each of said plurality of sheets of metal (5, 6) to form a pair of opposed receptor structures (13, 14);

constructing a framework (1) having vertical supports (4) with both rectilinear channels, for receiving said longitudinal edges (9, 10), and a plurality of transverse support zones (8), at spaced intervals along each of said vertical supports, for securing two of said plurality of juxtaposed sheets of metal to said framework (1), and each said support zone (8) supporting a mating pair of opposed transverse separately retractable counteractive pressure elements (11, 12) for sandwiching and securing said receptor structures (13, 14) of two of said plurality of juxtaposed sheets of metal therebetween;

placing said longitudinal edges of two of said plurality of sheets of metal in each of said channels with said pressure elements being sufficiently spaced from one another to allow passage of said longitudinal edges of two of said plurality of sheets of metal therethrough; and biasing said longitudinal edges of two of said plurality of sheets of metal located within said channels into direct contact with one another, via said mating pair of pressure elements, to immobilize two of said plurality of sheets of metal to said framework.

10. The method according to claim 9, further comprising the step of providing each of said mating pair of pressure elements (11, 12) with an elastic recall means for constantly biasing each said pressure element into an active operative position and facilitating retraction of said pressure element into a retracted inoperative position.

11. A covered type container formed of a plurality of sheets of metal being supported by a framework, said covered type container comprising a plurality of lateral surface walls being interconnected by a plurality of angled posts, a base, and an upper covering structure, each lateral surface wall comprising a plurality of juxtaposed sheets of metal (5, 6) covering said framework (1), said framework including a plurality of horizontal girders (2, 3) being assembled to vertical posts (4), the extremities of mating pairs of opposed horizontal girders (2, 3) being spaced apart from one another a sufficient distance to form a rectilinear recessed receptor channel (7) therebetween, each of said plurality of sheets on metal (5, 6) having longitudinal edges (9, 10) having locking receptors (13, 14) which engage edge-to-edge within one of said rectilinear receptor channels (7), each of said receptor channels (7) having a plurality of transverse support zones (8), at spaced intervals along each of said vertical posts (4), for securing two of said plurality of juxtaposed sheets of metal to said framework, each said support zone (8) supporting a mating pair of opposed transverse separately retractable counteractive pressure elements (11, 12) for sandwiching and securing said receptor structures (13, 14) of two of said plurality of juxtaposed sheets of metal therebetween with adjacent surfaces of said receptor structures (13, 14) directly contacting one another.

12. The container according to claim 11, wherein the upper covering structure (38) includes a network (39) of upper girders (40) and upper cross pieces (41) and a subsurface which comprises a plurality of juxtaposed sheets of metal with bent longitudinal edges which are supported by said network via locking members, said network (39) is connected at an upper portion of the plurality of lateral surface walls (34,35) by a flat tubular element (43) which forms a mechanical retaining edge, and said retaining edge (43) is integral with said upper girders (40).

13. The container according to claim 11, wherein a connection between two adjacent lateral walls is formed at an angled post (36), said angled post (36) is flanked on two interior lateral surface by a vertical tubular contact element (44, 45) which has a width that is shorter than a width of an adjacent side of said angled post (36) so as to form a space (46) for accommodating and locking with said longitudinal edge (9,10) of one of said plurality of sheets of metal at least partially forming one of the two adjacent lateral walls.

14. The container according to claim 11, wherein a connection between said base and a horizontal wall (47) is formed at an angled post (36), said angled post (36) is flanked on two lateral surface by a tubular contact element (44, 45) which has a width that is shorter than a width of an adjacent side of said angled post (36) so as to form a space

(46) for accommodating and locking with said longitudinal edge (9,10) of one of said plurality of sheets of metal at least partially forming one of said base and said horizontal wall (47).

15. The container according to claim 11, wherein a connection between said base and an inclined wall (48) is formed by a lower edge (49) composed of two elements (50, 51) forming an upside-down "L" configuration, said inclined wall (48) is wedged diagonally against one (51) of the two vertical elements of the lower edge (49), via a wide angle extremity support (52) formed integral with the lower edge (49) of said base, and a mechanism is provided for sealing extremities of said plurality of sheets of metal supported by adjacent lateral walls and the inclined wall (48).

16. The container according to claim 11, wherein a reinforcement element (60) is inserted in a housing formed by said longitudinal edges (57, 58) of said juxtaposed sheets of metal (55, 60), said reinforcement element (60) is immobilized in relation to said sheets of metal via at least one screw (66, 67), said reinforcement element (60) cooperates with a threaded rod (61) integral with said reinforcement element (60), said threaded rod traverses a connecting support (62) supported by two spaced apart beams (63, 64) of a transverse girder located above a transverse separating compartment (54) formed within said container, and said threaded rod supports a screw-washer unit (65) which contacts an upper surface of said connecting support (62) whereby adjustment of said threaded rod (61) relative to said screw-washer unit (65) applies vertical tension to sheets of metal.

17. A method of forming a desired structure from a plurality of juxtaposed sheets of metal being suspended from a framework, said method comprising the steps of:

bending two opposing longitudinal edges (9, 10) of each of said plurality of juxtaposed sheets of metal (5, 6) to form two wings (15) which each have a receptor structure (13, 14);

constructing a framework (1), from horizontal and vertical supports (2, 3, 4), with both rectilinear channels, for receiving said two wings therein, and a plurality of transverse support zones (8), at spaced intervals along each of said vertical supports, for securing two of said plurality of juxtaposed sheets of metal to said framework (1), each said support zone (8) supporting a mating pair of opposed transverse separately retractable counteractive spring biased pressure elements (11, 12) for solely sandwiching and securing said two wings of two of said plurality of juxtaposed sheets of metal therebetween;

placing said wings of two of said plurality of sheets of metal in each of said channels with said pressure elements being sufficiently spaced from one another to allow passage of said wings of two of said plurality of sheets of metal therethrough; and biasing said wings of said two of said plurality of sheets of metal located within said channels, via said pressure elements, into direct contact with one another to immobilize said two of said plurality of sheets of metal to said framework.

18. The method according to claim 17, wherein said pressure elements (11, 12) are progressively retractable and are return to the active position by elastic means and said framework has means for applying vertical tension to said sheets of metal.

* * * * *